US005451733A

United States Patent [19]

Olson et al.

[11] Patent Number: 5,451,733

[45] Date of Patent: Sep. 19, 1995

[54] COMBINATION LOW OIL INDICATOR AND KILL SWITCH FOR INTERNAL COMBUSTION MAGNETO DRIVEN ENGINE

[75] Inventors: Richard M. Olson, Newington; William R. Stephens, Rocky Hill, both of Conn.

[73] Assignee: Carlingswitch, Inc., Plainville, Conn.

[21] Appl. No.: 173,984

[22] Filed: Dec. 28, 1993

[51] Int. Cl.[6] ..... H01H 9/00

[52] U.S. Cl. ..... 200/315; 200/553; 200/562

[58] Field of Search ..... 200/315, 553, 557, 558, 200/561, 562, 563, 310, 314, 316, 312

[56] References Cited

U.S. PATENT DOCUMENTS 4,101,749 7/1978 Josemans et al. ..... 200/310

FOREIGN PATENT DOCUMENTS 2151990 8/1980 Germany ..... 200/315

3706681 9/1988 Germany ..... 200/315

*Primary Examiner*—Henry J. Recla

*Assistant Examiner*—David J. Walczak

*Attorney, Agent, or Firm*—McCormick, Paulding & Huber

[57] ABSTRACT

An electrical switch has three terminals, one that is always connected to one side of an LED and in parallel to a resistor. A rocker slides a movable contact to and from an engine OFF or kill position, from and to an engine RUN position. An oil detector circuit uses the engines magneto system to light the LED when the switch is in the RUN position and the engine is rotated. The flashing LED provides a visual indication of low oil in the engine.

4 Claims, 2 Drawing Sheets

COMBINATION LOW OIL INDICATOR AND KILL SWITCH FOR INTERNAL COMBUSTION MAGNETO DRIVEN ENGINE

BACKGROUND OF THE INVENTION

This invention relates generally to switch constructions, and deals more particularly with a combination kill switch and indicator light for an internal combustion engine of the type driven by a magneto ignition system.

Applicant is aware of the following prior art patents as bearing some relevancy to the disclosure provided in the subject application. U.S. Pat. No. 4,347,417 illustrates a rocker switch having an internal lamp with a coil compression spring provided for continuous connection with that lamp.

Another prior art patent of relevance to the subject disclosure is U.S. Pat. No. 4,454,400 wherein a lamp is provided in a rocker of a switch that also includes means for providing a resistor in that rocker as well. Both these U.S. Pat. Nos. 4,347,417 and 4,454,400 utilize a spring element provided on a depending post on the rocker so as to afford electrical connection between the lamp, the resistor and the rocker itself, and a movable contact that is engaged by the spring so as to urge that movable contact downwardly against one or more fixed contacts in the bottom wall of the switch case.

The general purpose of the present invention is to provide a unique application for a switch of the type disclosed in the above-identified prior art patents, and more particularly to provide a unique switch construction that is well adapted to serve as both a low oil indicator light and a kill switch for an internal combustion engine of the type having a magneto ignition system.

SUMMARY OF THE INVENTION

In accordance with the present invention a switch housing is provided with a rear wall having three terminals, a rocker is pivotably supported in the housing and is movable between engine RUN and engine OFF positions, a movable contact slides across the upper ends of these fixed terminals as a result of pivotal movement of the rocker. The rocker in the engine OFF position bridges two of these three terminals and in the engine RUN position contacts only one of them. The third terminal is connected by a compression spring to an LED and in parallel to a resistor. As so constructed and arranged the third terminal can be electrically coupled to the ignition coil of the engine magneto system with the result that electrical energy is provided, at least when the engine is running, to the LED. In the engine OFF position the LED is not grounded. The one terminal of the switch is grounded through a float type oil level detector circuit. The detector circuit does not have its own source of electricity and depends upon rotation of the engine and electricity from the magneto ignition system to light the LED. In the engine ON or run position this electrical energy from the rotating engine and its associated magneto ignition system is provided to the LED only through the ground afforded by the float type oil level detector circuit.

DETAILED DESCRIPTION

Figure 2:
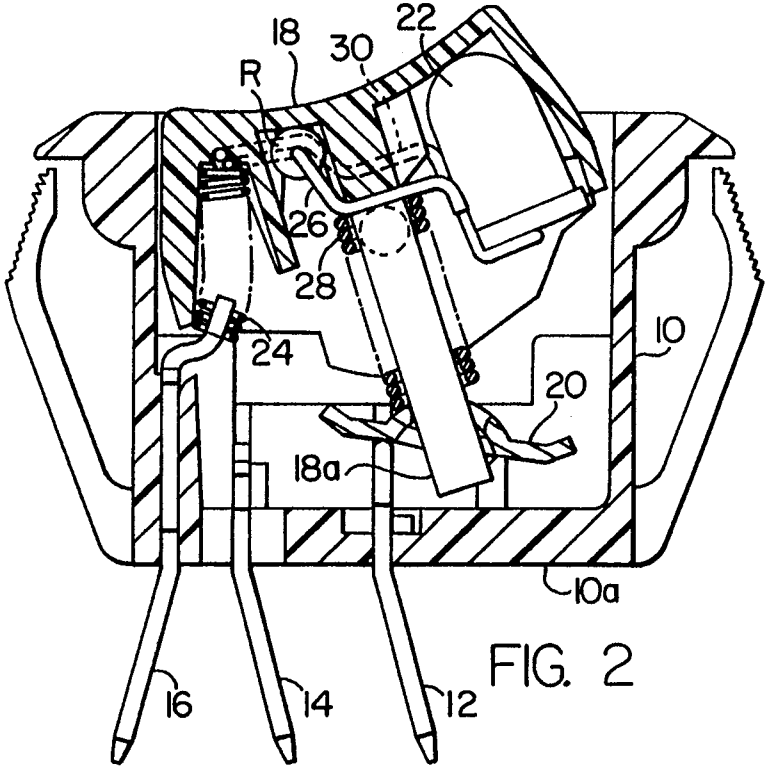
FIG. 2 is a view of the same switch shown in FIG. 1, but illustrates the moving components in the engine run condition.
Figure 1:
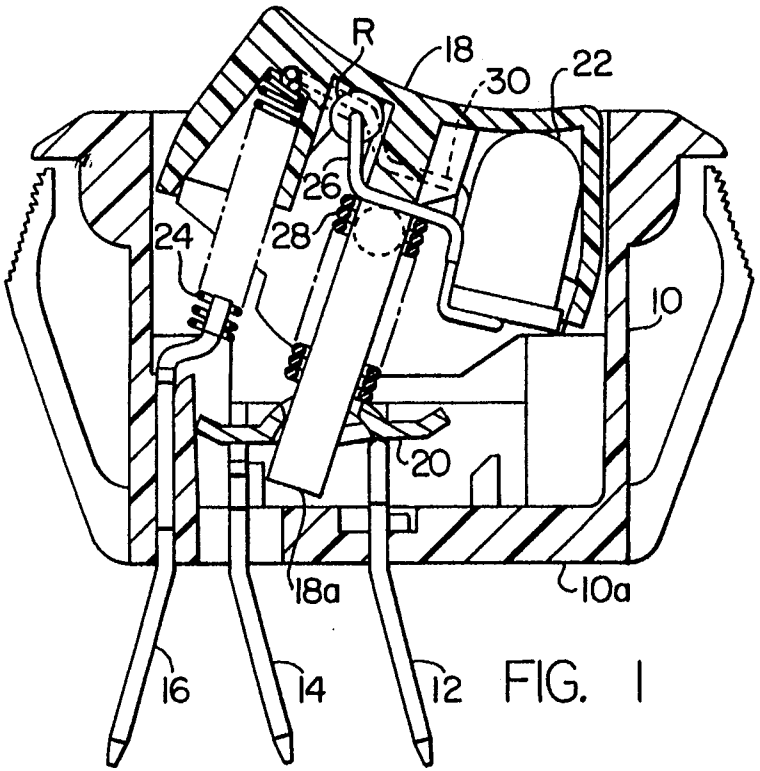
FIG. 1 shows the structural details of a switch constructed in accordance with the present invention, this view being shown in vertical section with certain components illustrated schematically and/or in full lines, and hidden portions being illustrated in broken lines. The full line position shown corresponds to the engine OFF condition.

Turning now to the drawings in greater detail, FIGS. 1 and 2 show an electrical switch incorporating the features of the present invention. These views illustrate in vertical elevation a single pole electrical switch in alternative positions. The switch includes a thermoplastic housing 10 having a bottom or rear wall 10*a* in which a plurality of terminals are provided, preferably three terminals 12, 14 and 16. The switch housing 10 is upwardly open and defines a generally rectangular top opening for pivotably receiving a rocker 18. The rocker 18 like the switch housing is fabricated from a plastic material and includes a depending stem 18*a*. The stem 18*a* moves between the positions shown for it in FIGS. 1 and 2 so as to carry with it a movable contact 20. FIG. 1 shows the movable contact bridging the upper ends of the two fixed contacts 12 and 14. In the FIG. 2 position the movable contact 20 is provided in contact only with the one contact 12, the second contact 14 being spaced from the movable contact 20 in this engine RUN position.

The rocker 18 is preferably translucent so as to pass light from a source of illumination in the form of an LED 22 provided in a downwardly open cavity defined for this purpose in the rocker 18. The LED 22 has one terminal connected to the movable contact 20, through the spring 28. A coiled compression spring 24 extends from the upper end of the terminal 16 to the resistor R, which is provided in this LED circuit also (see FIG. 3). This circuit is the same for both the engine OFF and engine RUN positions (see FIG. 4).

With reference to FIGS. 1 and 2 the rocker 18 and the resistor R are provided in suitable cavities defined for this purpose in the underside of the rocker 18. The resistor R is electrically connected to the conductive lead 26 as shown in FIGS. 1 and 2. In addition, the resistor has its opposite end (not shown in FIGS. 1 and 2) electrically connected to the conductive wire 30 also provided in the rocker 18.

Figure 4:
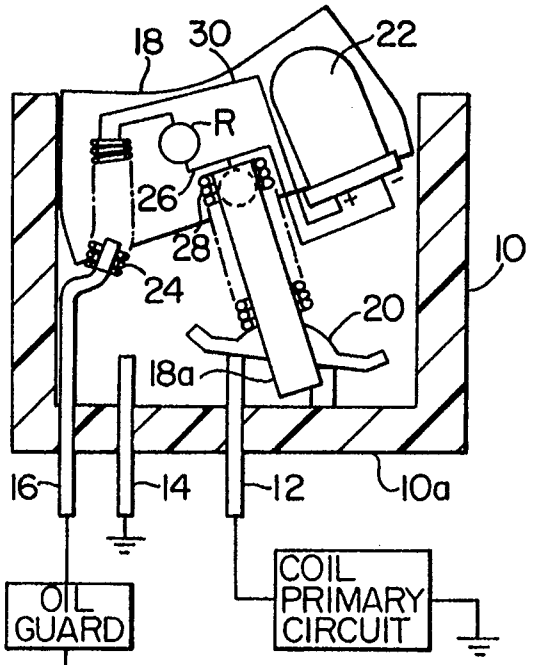
FIG. 4 is a view similar to FIG. 3, but illustrates the switch of FIG. 3 in its engine RUN position.
Figure 3:
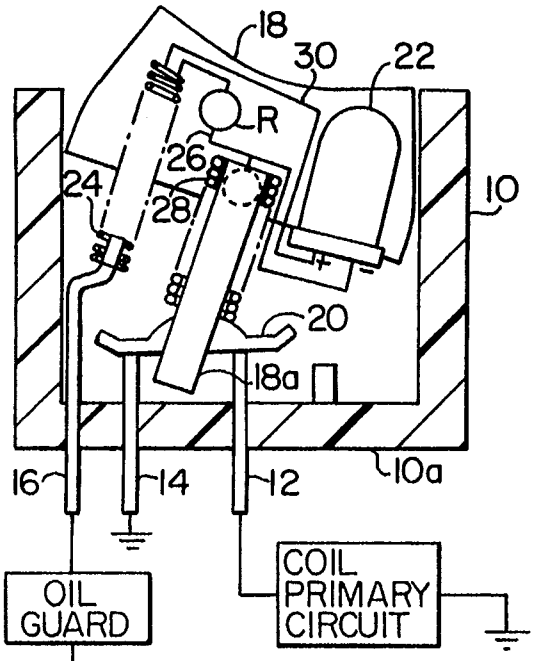
FIG. 3 is a schematic view of the switch illustrated in FIGS. 1 and 2, the rocker being shown in the engine OFF position.

Turning now to the schematic views of FIGS. 3 and 4, the electrical switch of FIGS. 1 and 2 as illustrated in these views is coupled to conventional components of a typical internal combustion engine of the type adapted to run on a magneto type ignition system. The engine is also fitted with a conventional float type oil level detector circuit, and the circuit includes a float level detector switch. It is a feature of the present invention that no external electrical source is provided for this circuit and that such a float type oil level detector operates solely from the primary coil of the engine's magneto.

The primary coil circuit of the magneto driven ignition system is coupled to terminal 12 which is one of the two terminals, 12, 14 engaged by the movable contact 20, and provides the source of electricity to the electrical switch, as long as the internal combustion engine is rotating. When the engine is not rotating the engine's magneto system will generate no electricity and therefore no energy is provided to the switch or to the float type oil level detector.

It is an important feature of the present invention that the resistor R is provided in electrical parallel with the LED 22 in the circuitry shown schematically in FIGS. 3 and 4. This configuration assures that excessive voltage is not applied to the LED, and assures reliable operation of the LED as a light source to indicate a low oil level in the internal combustion engine under conditions to be described. As shown in FIG. 4, with the rocker 18 provided in the engine RUN position, rotation of the engine, as by an electrical or a manual starting operation, will achieve electrical energization of the float type oil detector circuit. Thus, should the oil level in the engine be too low, the LED 22 will illuminate, at least in an intermittent fashion as a result of the electrical energy supplied by the primary coil of the magneto through the third terminal 16, the compression spring 24, the conductor 30 the spring 28 on the stem 18*a* and the movable contact 20 as well as the first terminal 12.

In the schematic view of FIG. 3, the "kill" position for the switch is shown. In this engine OFF or "kill" switch position even rotation of the engine will cause electricity to be generated by the magneto ignition system through the primary coil, but no electricity will flow through the resistor and LED because of the shunt provided by the second terminal 14. Thus, a ground for the magneto prevents the engine from starting in this "kill" switch position.

FIG. 4 shows schematically that in the engine RUN position the oil level detector circuit or oil guard is energized, through the LED and the resistor, from the engine magneto or coil primary circuit.

We claim:

1. In combination with the primary coil circuit of an electrical magneto system wherein the coil requires an electrical ground, and wherein a two-way electrical kill switch is provided in such a circuit, the improvement to the two-way switch comprising:

a housing having a rear wall with three terminals, a rocker pivotably supported in the housing and movable between engine RUN and engine OFF positions, a movable contact movable in response to pivotal movement of the rocker to bridge two of said three terminals in said engine OFF position and to contact only one of said two terminals in said engine run position, a third terminal and a compression spring provided in said housing for engaging said third terminal, an LED in said rocker and a resistor also in said rocker, said LED and resistor provided in electrical parallel with one another, said third terminal electrically connected to one side of said LED and one side of said resistor through said compression spring, a second of said two terminals electrically connected to said third terminal when said rocker is in said engine OFF position whereby said electrical switch in said ON position is adapted to provide electrical energy to a low oil quantity indicator circuitry in an internal combustion engine equipped with such a magneto system.

2. The combination of claim 1 wherein the second of said two terminals is adapted to be electrically coupled to the ignition coil of the engine magneto system.

3. The combination of claim 2 wherein said third terminal is adapted to be electrically coupled to electrical ground through a low oil warning circuit that has no electrical energy source and that is operable only when serving as ground for the magneto system of the engine.

4. The combination of claim 3 wherein said electrical parallel circuit provided for said resistor and LED includes a spring acting between said rocker and said movable contact, said rocker including a depending stem for locating said spring and assuring contact between said spring and said movable contact.

* * * * *